US008650758B2

(12) United States Patent
Wain et al.

(10) Patent No.: US 8,650,758 B2
(45) Date of Patent: Feb. 18, 2014

(54) RAZOR BLADE ASSEMBLY PRE-FORM

(75) Inventors: Kevin James Wain, Reading (GB); Mark Peterson, Reading (GB)

(73) Assignee: The Gillette Company, Boston, MA (US)

( * ) Notice: Subject to any disclaimer, the term of this patent is extended or adjusted under 35 U.S.C. 154(b) by 1110 days.

(21) Appl. No.: 12/260,407

(22) Filed: Oct. 29, 2008

(65) Prior Publication Data

US 2009/0113716 A1 May 7, 2009

Related U.S. Application Data

(60) Provisional application No. 61/001,616, filed on Nov. 2, 2007.

(51) Int. Cl.
*B26B 21/00* (2006.01)

(52) U.S. Cl.
USPC ..... 30/50; 30/344

(58) Field of Classification Search
USPC ..... 30/50, 344, 40.1, 34.2
See application file for complete search history.

(56) References Cited

U.S. PATENT DOCUMENTS 1,713,079 A * 5/1929 Hall, Jr. ..... 30/36
3,816,913 A 6/1974 Ferraro
3,889,369 A * 6/1975 Ferraro ..... 30/346.58
4,227,302 A 10/1980 Torrance
4,253,236 A 3/1981 Jacobson
4,510,687 A * 4/1985 Groothuis et al. ..... 30/34.2
5,104,605 A 4/1992 Butlin et al.
5,182,858 A 2/1993 Chen
5,236,439 A 8/1993 Kosikowski
5,388,332 A 2/1995 Olroyd
5,822,862 A 10/1998 Ferraro
6,115,924 A 9/2000 Olroyd
6,173,498 B1 1/2001 Warrick et al.
6,877,227 B2 * 4/2005 Santhagens Van Eibergen et al. ..... 30/50
7,024,776 B2 4/2006 Wain
7,047,646 B2 5/2006 Coffin
7,131,203 B2 * 11/2006 Wain ..... 30/57
7,200,938 B2 4/2007 Lembke
2002/0023352 A1 2/2002 Mil'shtein
2003/0208907 A1 11/2003 Brown et al.
2005/0015991 A1 1/2005 Follo et al.
2006/0218794 A1 10/2006 Bunnell et al.
2007/0056167 A1 3/2007 Richard et al.

* cited by examiner

*Primary Examiner* — Omar Flores Sanchez
(74) *Attorney, Agent, or Firm* — Kevin C. Johnson; Steven W. Miller

(57) ABSTRACT

A shaving blade assembly pre-form comprising a blade frame comprising transverse connecting strips; a plurality of blades welded to the blade frame that span the transverse connecting strips along a length of the frame; and a disposable tie disposed parallel to the plurality of blades and across said transverse connecting strips.

20 Claims, 5 Drawing Sheets

RAZOR BLADE ASSEMBLY PRE-FORM

CROSS REFERENCE RELATED APPLICATION

This application claims the benefit of U.S. Provisional Application No. 61/001,616, filed Nov. 2, 2007.

FIELD OF THE INVENTION

The present invention relates to a shaving blade assembly pre-form that is useful during the manufacture of a wet shaving razor cartridge.

BACKGROUND OF THE INVENTION

This invention relates to a shaving blade assembly pre-form that comprises a blade frame comprising transverse connecting strips; a plurality of blades that are welded to the blade frame and that span the transverse connecting strips placed along a length of the frame; and a disposable tie disposed parallel to said plurality of blades and across said transverse connecting strips.

It is well known in the wet shaving manufacturing field to incorporate shaving blades joined to blade supports onto a substantially rigid or rigid cartridge housing. It is, however, easily recognizable by shaving consumers when a razor cartridge is too rigid. This typically arises as a result of being nicked or cut by a razor blade that does not follow the contour of the skin but rather abruptly engages with the skin instead of the hair on the skin.

One way to alleviate this discomfort that plagues shaving consumers has been to provide razors that have more flexible configurations. For instance, in U.S. Pat. No. 6,804,886 B2, Applicant discloses a blade unit that is incorporated in a resiliently compliant blade support structure. In particular, the blade unit includes a blade assembly comprising a plurality of parallel blades mounted on a razor handle by a flexible support structure. Each of the blades consists of an elongate blade element having a forward edge section with a sharp cutting edge, and a planar blade section extending rearwardly from the forward edge section, which is upwardly inclined by bending a blade element back from the tip of the cutting edge. Even in configurations as those described in U.S. Pat. No. 6,804,886 B2, there is no mention of a method of ensuring that the blade to blade span, blade angle, and blade geometry may be preserved during the attachment of the blade portion to the unit. As detailed in U.S. Pat. No. 6,212,777, it has been determined that a progressive blade geometry is key to ensuring the delicate balance of a close shave but not so close so as to cause nicking.

Consequently, based on these previous approaches to providing a comfortable and effective shaving experience, there is still a need for a conforming razor product that overcomes these difficulties experienced during manufacturing as well as during shaving. In particular, Applicant has found a manner to preserve the desired blade geometry through blade attachment to the blade frame during manufacture of a razor product.

SUMMARY OF THE INVENTION

The present invention relates to a shaving blade assembly pre-form comprising a blade frame comprising transverse connecting strips, a plurality of blades welded to the blade frame that span said transverse connecting strips along a length of the frame; and a disposable tie disposed parallel to said plurality of blades and across said transverse connecting strips.

DETAILED DESCRIPTION OF THE INVENTION

Figure 1:
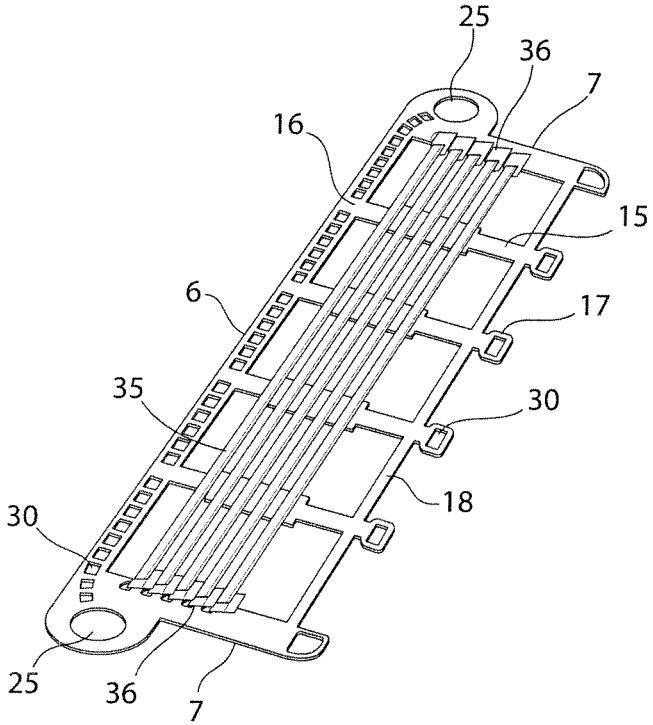
FIG. 1 shows a top perspective of the blade assembly pre-form of the present invention.
Figure 2:
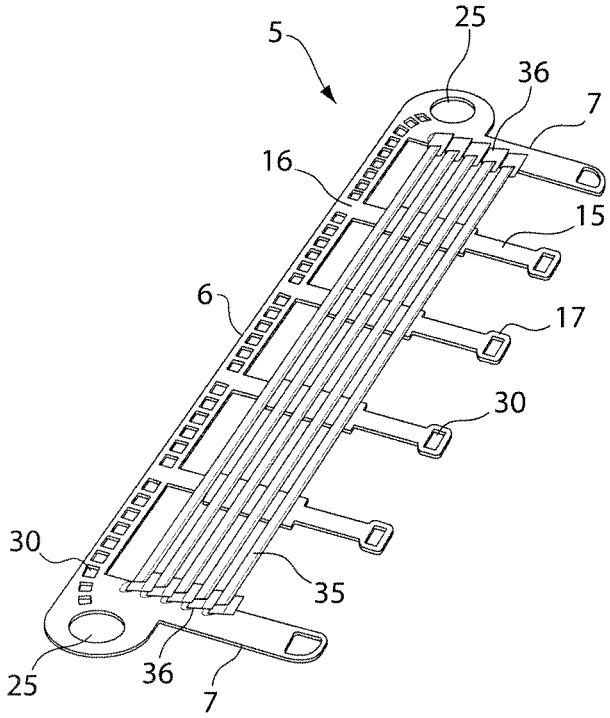
FIG. 2 shows a top perspective of the blade assembly pre-form of the present invention subsequent to removal of the disposable tie.
Figure 3A:
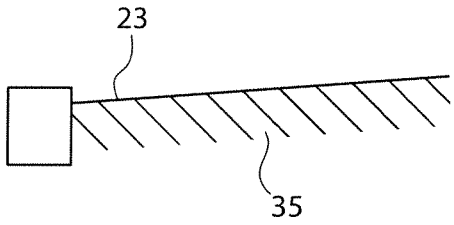
FIG. 3A illustrates diagrammatically the deleterious splaying that occurs relative to the blade geometry in the absence of implementation of the pre-form of the present invention.
Figure 3B:
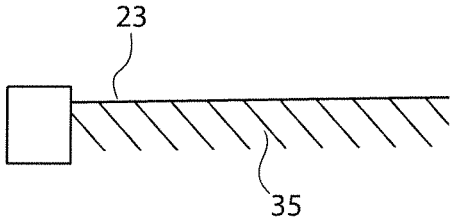
FIG. 3B illustrates diagrammatically the anti-splaying effect the pre-form of the present invention exhibits relative to blade geometry.
Figure 5:
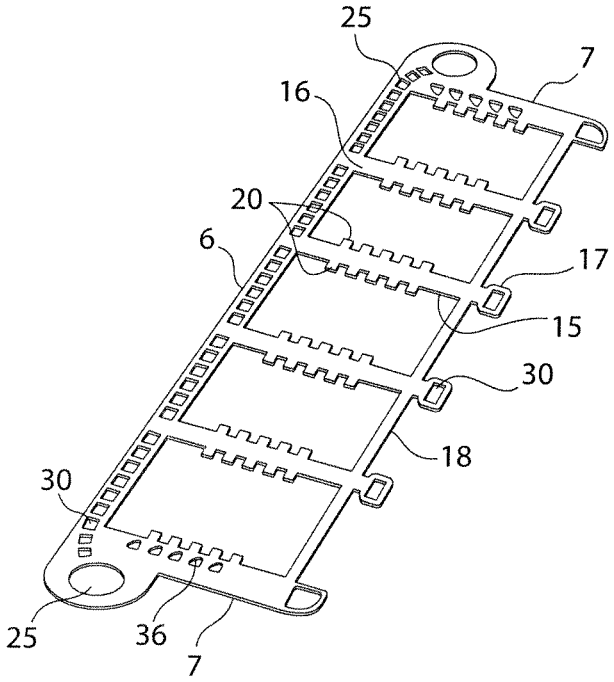
FIG. 5 shows a top perspective of the blade assembly pre-form prior to the joining of the shaving blade members.

FIGS. 1 and 2 show the shaving blade assembly pre-form 5 of the present invention which includes a blade frame 10 that has transverse connecting strips 15. The blade frame 10 serves as the platform for the formation of the pre-form 5 as it comprises a top portion 6 that has a length substantial enough to accommodate a plurality of shaving blade members 35. The shaving blade members 35 are joined to the connecting strips 15 on a plurality of opposing pairs of support wings 20 (shown in FIG. 5) that occupy space along a length of each of the strips. The shaving blade members may be joined to the wings 20 instead of to a central longitudinal area on the transverse connecting strips to increase the core strength of the strip, particularly when such joining occurs as a result of welding. At each longitudinal end of the top portion 6 is disposed a perpendicular end portion 7 that supports the shaving blade member 35 at its opposing ends 36. Each of the transverse connecting strips 15 has a proximal end 16 that is connected to or integral with an area of the top portion 6. There is also an opposite distal end 17 on each of the transverse connecting strips 15. It is near each of these distal ends 17 where the disposable tie 18 is position to run parallel to the top portion 6 of the blade frame 10. The disposable tie 18 serves to anchor the remaining portions of the blade frame 10 so that there is minimal to no buckling or splaying of the frame 10 as successive shaving blade members 35 are joined to the blade frame. As indicated above, it is desirable for the shaving blade members to possess a particular geometry relative to a guard that is typically present within a razor cartridge as shown in FIG. 3A which shows a cutting edge 23 of each successively placed shaving blade member relative to a height established by a datum point within the guard. Preferably, a razor cartridge exhibits a progressive geometry as detailed in U.S. Pat. No. 6,212,777. Oftentimes, however, as shaving blade members are incorporated within a cartridge housing, and in this case a blade frame, the originally planned geometry could be deleteriously affected by the forces incurred by the blade frame as a consequence of welding a shaving blade member in a position along the frame's length and then welding successive shaving blade members onto this same frame progressively away from the top portion 6 toward the location of the disposable tie and closer to a guard. The anchoring performed by the disposable tie 18 manifests itself in securing the distal ends of the respective transverse connecting strips 18 within the original horizontal (x) plane of the entire blade frame 10. Typically, as successive shaving blade members are joined to the blade frame there is a tendency for the entirety of the blade frame to take on a concaveness with a central region of the blade frame rising upwards out of the original horizontal (x) plane of the blade frame's pre-attachment state (as shown in FIG. 3B). The resulting concaveness additionally incurs the drawing in of the opposing perpendicular end portions of the blade frame. This unintended frame distortion has a negative effect on the blade geometry that results as successive shaving blade members are joined to the frame. Additional distortion may result from the bending and trimming of certain frame portions as well. Therefore, the disposable tie prevents the occurrence of any unintentional departure from the intended geometry.

Figure 4:
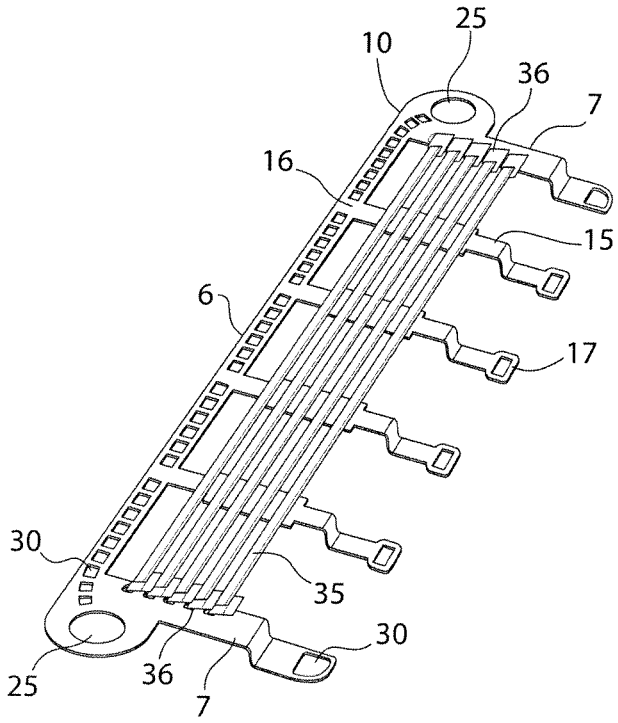
FIG. 4 shows a top perspective of a pre-form of the present invention that has undergone bending of the transverse connecting strips.

Once the shaving blade members are all joined to the blade frame, the disposable tie and any additional disposable portions may be disjoined from the frame. This disjoinder may occur as a result of stamping, cutting, laser heating, and combinations thereof. Once the joining of the shaving blade members to the blade frame occurs as well as any necessary bending of the distal ends of the transverse connecting strips, the resultant shaving blade assembly is suitable for incorporation into a cartridge as described in co-pending U.S. application Ser. No. 61/001,617 entitled "Conforming Wet Shaving Razor" filed in the name of Kevin J. Wain on Nov. 2, 2007. FIG. 4 also shows a pre-form per the invention post bending of the distal ends of the transverse connecting strips and post removal of the disposable tie.

Additional features of the pre-form may include, but are not limited to, positioning holes 25. The pre-forms may include these holes to aid in the handling of the pre-form during cartridge manufacture. In particular, they serve as receptacles for weld fixtures portions that carry the pre-form from one position in the manufacturing process to another. The pre-form may also comprise flowthrough vents 30 that may be present in various regions of the frame and its respective parts, e.g., top portion, perpendicular end portion, distal ends, etc. In particular embodiments, the vents 30 may occur in a plurality along different portions along a length of the top portion of the frame. These vents 30 aid in the "capture" and retention of the processed pre-form (e.g., post welding, bending, and/or tie removal) as a molten cartridge material is formed around the pre-form to the razor cartridge. The vents permit the molten material to be delivered through and remain in the vent as the cartridge form hardens thereby leading to a pre-form that is enveloped in the cartridge material and not so easily removed from the cartridge body.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving blade assembly pre-form comprising:

a. a blade frame comprising transverse connecting strips;

b. a plurality of blades welded to said blade frame that span said transverse connecting strips along a length of the frame; and c. a disposable tie disposed parallel to said plurality of blades and across said transverse connecting strips, wherein said disposable tie is removed prior to incorporation of said frame into a razor cartridge.

2. The shaving blade assembly pre-form of claim 1 wherein said frame comprises a location hole.

3. The shaving blade assembly pre-form of claim 2 wherein said location hole is disposed adjacent a longitudinal end of said frame.

4. The shaving blade assembly pre-form of claim 1 wherein said transverse connecting strips comprise a plurality of opposing support wings.

5. The shaving blade assembly pre-form of claim 1 wherein said blade frame comprises a flowthrough vent.

6. The shaving blade assembly pre-form of claim 5 wherein said blade frame comprises said vent at a distal end of a transverse connecting strip.

7. The shaving blade assembly pre-form of claim 5 wherein said vent occur in a plurality along different areas of a top portion of said frame.

8. A shaving blade assembly pre-form comprising:

a. a blade frame comprising transverse connecting strips and a flow through vent;

b. a plurality of blades welded to said blade frame that span said transverse connecting strips along a length of the frame; and c. a disposable tie disposed parallel to said plurality of blades and across said transverse connecting strips.

9. The shaving blade assembly pre-form of claim 8 wherein said frame comprises a location hole.

10. The shaving blade assembly pre-form of claim 9 wherein said location hole is disposed adjacent a longitudinal end of said frame.

11. The shaving blade assembly pre-form of claim 8 wherein said transverse connecting strips comprise a plurality of opposing support wings.

12. The shaving blade assembly pre-form of claim 8 wherein said blade frame comprises said vent at a distal end of a transverse connecting strip.

13. The shaving blade assembly pre-form of claim 8 wherein said vent occur in a plurality along different areas of a top portion of said frame.

14. A shaving blade assembly pre-form comprising:

a. a blade frame comprising transverse connecting strips;

b. a plurality of blades welded to said blade frame that span said transverse connecting strips along a length of the frame; and c. a disposable tie disposed parallel to said plurality of blades and across said transverse connecting strips, wherein said disposable tie is removed after incorporation of said frame into a razor cartridge.

15. The shaving blade assembly pre-form of claim 14 wherein said frame comprises a location hole.

16. The shaving blade assembly pre-form of claim 15 wherein said location hole is disposed adjacent a longitudinal end of said frame.

17. The shaving blade assembly pre-form of claim 14 wherein said transverse connecting strips comprise a plurality of opposing support wings.

18. The shaving blade assembly pre-form of claim 14 wherein said blade frame comprises a flowthrough vent.

19. The shaving blade assembly pre-form of claim 18 wherein said blade frame comprises said vent at a distal end of a transverse connecting strip.

20. The shaving blade assembly pre-form of claim 18 wherein said vent occur in a plurality along different areas of a top portion of said frame.

* * * * *